US006394585B1

(12) United States Patent
Ross

(10) Patent No.: US 6,394,585 B1
(45) Date of Patent: May 28, 2002

(54) INK JET PRINTING USING DROP-ON-DEMAND TECHNIQUES FOR CONTINUOUS TONE PRINTING

(75) Inventor: David S. Ross, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/738,922

(22) Filed: Dec. 15, 2000

(51) Int. Cl.[7] ..... B41J 2/04
(52) U.S. Cl. ..... 347/54; 347/82
(58) Field of Search ..... 347/54, 68, 69, 347/70, 71, 72, 50, 40, 73–78, 82, 47; 399/271; 361/700; 310/328–330; 29/890.1

(56) References Cited

U.S. PATENT DOCUMENTS 1,941,001 A 12/1933 Hansell
3,878,519 A 4/1975 Eaton
4,490,728 A 12/1984 Vaught et al.
4,646,106 A 2/1987 Howkins
5,739,832 A 4/1998 Heinzl et al.
6,079,821 A 6/2000 Chwalek et al.

FOREIGN PATENT DOCUMENTS

GB 2 007 162 A 5/1979

*Primary Examiner*—Raquel Yvette Gordon
(74) *Attorney, Agent, or Firm*—Milton S. Sales

(57) ABSTRACT

Apparatus for controlling ink in an ink jet printer includes an ink delivery channel; a source of pressurized ink communicating with the ink delivery channel; a nozzle bore which opens into the ink delivery channel to establish an ink flow path, the nozzle bore defining a nozzle bore perimeter, inherent surface tension of pressurized ink in the nozzle bore forming an ink meniscus; and a selectively-actuated heater associated with the nozzle bore to cause a reduction in the surface tension of the ink when activated such that ink flows from the nozzle bore in a continuous stream substantially for the duration of activation of the heater only.

9 Claims, 6 Drawing Sheets

INK JET PRINTING USING DROP-ON-DEMAND TECHNIQUES FOR CONTINUOUS TONE PRINTING

FIELD OF THE INVENTION

This invention relates generally to the field of ink jet printers, and in particularly to a new print head technology which provides for continuous tone printing using drop-on-demand ink delivery techniques.

BACKGROUND OF THE INVENTION

Inkjet printing is a prominent contender in the digitally controlled electronic printing arena because, e.g., of its non-impact, low-noise characteristics, its use of plain paper, and its avoidance of toner transfers and fixing. Inkjet printing mechanisms can be categorized as either continuous inkjet or drop-ondemand inkjet.

Drop-on-demand inkjet printers selectively eject droplets of ink toward a printing medium to create an image. Such printers typically include a print head having an array of nozzles. Each nozzle communicates with a chamber that can be pressurized in response to an electrical impulse to induce the generation of an ink droplet from the outlet of the nozzle.

Great Britain Patent No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K.K. of Japan). U.S. Pat. No. 4,490,728, which issued to Vaught et al. in 1982, discloses an electrothermal drop ejection system which also operates by bubble formation to eject drops in a direction normal to the plane of the heater substrate. Rapid bubble formation provides the momentum for drop ejection.

Many drop-on-demand printers use piezoelectric transducers to create the momentary pressure necessary to generate an ink droplet. Examples of such printers are present in U.S. Pat. Nos. 4,646,106 and 5,739,832. Printers with piezoelectric transducers suffer from a difficulty in achieving continuous tone grayscale) color reproduction. The volume of ink drops has also been controlled in piezoelectric drop-on-demand printers by varying the applied energy, such as by adjusting the pulse height or pulse width of the applied electrical signal. This method tends to allow only a small volume variation.

FIG. 1 is a detail enlargement of a cross-sectional view of a single nozzle tip of the drop-on-demand ink jet printhead 16 according to another prior art drop-on-demand technology. An ink delivery channel 40 and a plurality of cylindrical nozzle bores 46 are etched in a silicon substrate 42. Ink 70 in delivery channel 40 is pressurized above atmospheric pressure to form a meniscus 60 which protrudes somewhat from nozzle rim 54 of heater 50. The force of surface tension, which tends to hold the drop in, balances the force of the ink pressure, which tends to push the drop out. FIG. 2 is an enlargement of a top view of the nozzle of FIG. 1. Nozzle rim 54 and heater annulus 50 located directly under nozzle rim 54 surround the periphery of nozzle bore 46. A pair of power and ground leads 59 connect drive circuitry to heater annulus 50.

Heater control circuits supply electrical power to the heater for a given time duration, as illustrated in FIG. 3.

Optimum operation provides a sharp rise in power to heater 50 at time "A", the start of the heater pulse. The power is maintained for the duration "B" of the heater pulse. The power falls rapidly at the end "C" of the heater pulse. The heater pulse controls expansion of a poised meniscus, separation of the drop, and the volume of the separated drop; although, this class of drop-on-demand printer cannot change size of drop easily, uses much energy, and is expensive to manufacture. The power pulse, shown in FIG. 3, should have a duration that is shorter than the formation and ejection time of the drop.

The large nozzle diameters required of prior art drop-on-demand printers restrict the pressure increase that is available to accelerate the fluid. That is, the pressure in the reservoir must not exceed atmospheric pressure by more than the Laplace pressure of a critically poised meniscus in the nozzle at room temperature. For aqueous inks in a 10 micron diameter nozzle, this pressure must be less than about 300,000 dynes/cm$^2$. The pressure in the reservoir must exceed atmospheric pressure by at least the Laplace pressure of the maximally-heated fluid. For aqueous inks in a 10 micron diameter nozzle, this pressure must be greater than 200,000 dynes/cm$^2$. Ejection times are only a few microseconds. The restriction of the pressure jump to less than 100,000 dynes/cm$^2$ makes it difficult to accelerate the fluid to the speed necessary in a practical printing system.

The above method also suffers from a difficulty in achieving continuous tone (grayscale) color reproduction, since the low ink pressure increase availability limits the variation in drop volume. In the prior art, the volume of separated ink can be slightly varied by changing the pulse length. Referring to FIG. 4, if the pulse is too long, i.e., such that the drop being formed has a diameter somewhat larger than the diameter of the nozzle bore, the drop will not be ejected. Rather, the drop will remain attached to the nozzle and spread on the print head, as shown in FIG. 5. This limits the practical drop size to be roughly twice the nozzle bore diameter.

Continuous ink jet printing dates back to at least 1929. See U.S. Pat. No. 1,941,001 to Hansell. Ink is emitted in a stream, breaks into droplets, and is electrostaticly charged. The charged drops may be deflected downstream by the presence of deflector plates that have a large potential difference between them. A gutter may be used to intercept the charged drops, while the uncharged drops are free to strike the recording medium. See U.S. Pat. No. 3,878,519.

In another class of continuous ink jet printers, such as disclosed in U.S. Pat. No. 6,079,821 issued Jun. 27, 2000 to Chwalek et al., an ink jet printer includes a delivery channel for pressurized ink to establish a continuous flow of ink in a stream flowing from a nozzle bore in a direction of propagation related to the orifice plane. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction. The placement accuracy of ejected drops is influenced by the line of contact between the meniscus of the ink to be ejected and the surface of the orifice from which the drops are ejected.

Generally, continuous ink jet printers require a gutter and an ink recycling mechanism. These are fairly complicated and subject to contamination not associated with drop-on-demand printing.

DISCLOSURE OF THE INVENTION

It is an object of the present invention to provide an inexpensive drop-on-demand printhead that ejects drops of a wide range of sizes without the requirement to provide a gutter and ink recycling mechanism found in continuous systems.

According to a feature of the present invention, apparatus for controlling ink in an ink jet printer includes an ink delivery channel; a source of pressurized ink communicating with the ink delivery channel; a nozzle bore opens into the ink delivery channel to establish an ink flow path, the nozzle bore defining a nozzle bore perimeter, inherent surface tension of pressurized ink in the nozzle bore forming an ink meniscus; and a selectively-actuated heater associated with the nozzle bore to cause a reduction in the surface tension of the ink when activated such that ink flows from the nozzle bore in a continuous stream substantially for the duration of activation of the heater only.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
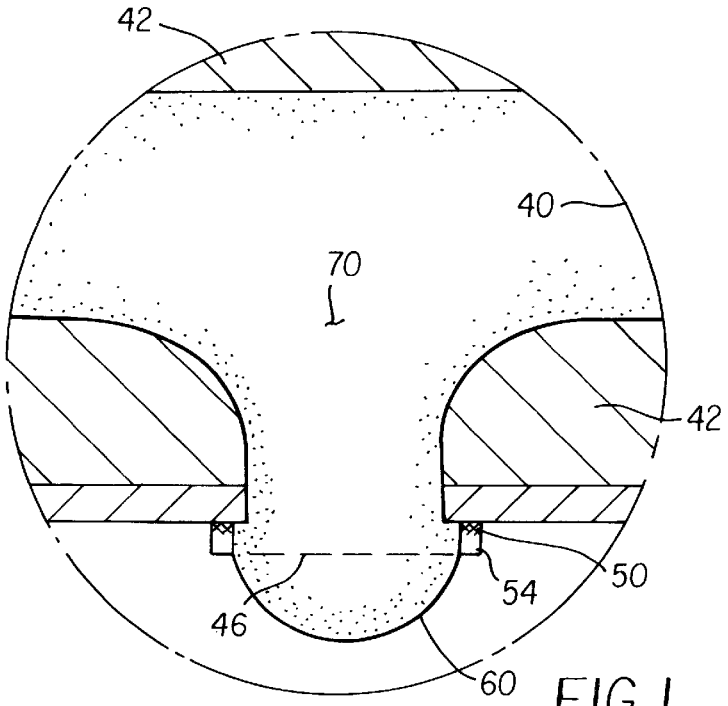
FIG. 1 (PRIOR ART)
FIG. 1 is a cross section of the nozzle tip of an ink jet print head in accordance with the prior art.
Figure 2:
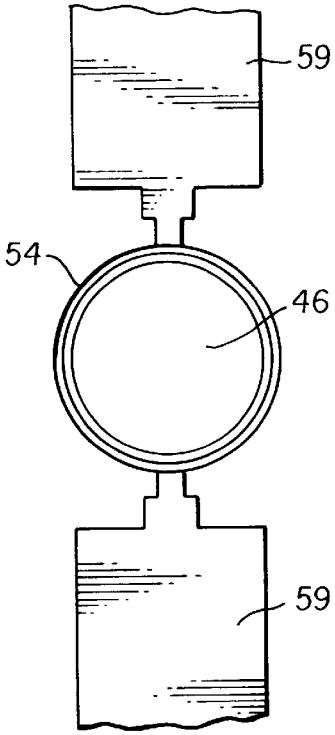
FIG. 2 (PRIOR ART)
FIG. 2 a top view of the prior art nozzle tip of FIG. 1.
Figure 3:
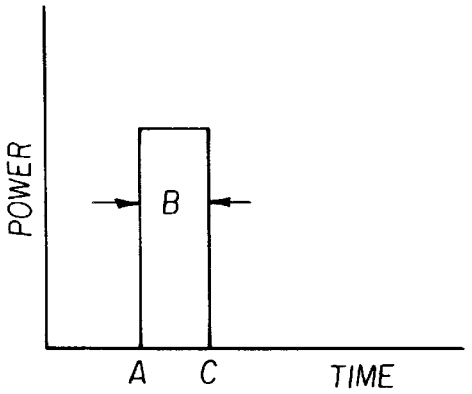
FIG. 3 (PRIOR ART)
FIG. 3 is a graph showing the operation of the prior art print head of FIGS. 1 and 2.
Figure 4:
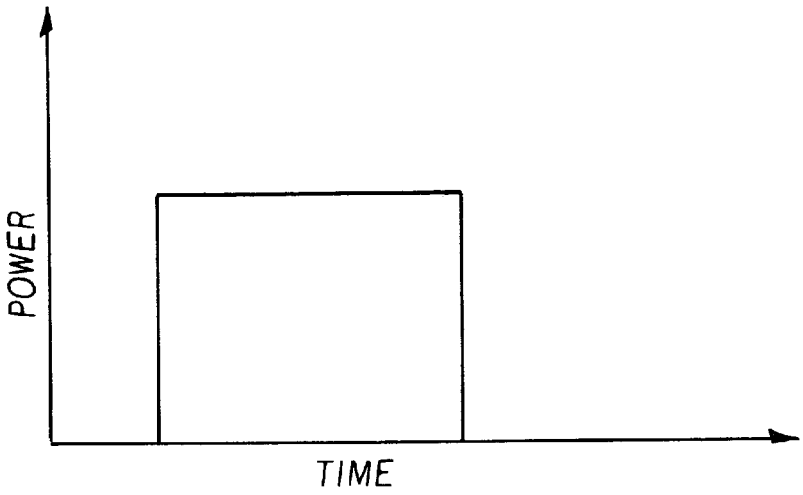
FIG. 4 (PRIOR ART)
FIG. 4 is a graph showing a possible operation of the prior art print head of FIGS. 1 and 2.
Figure 5:
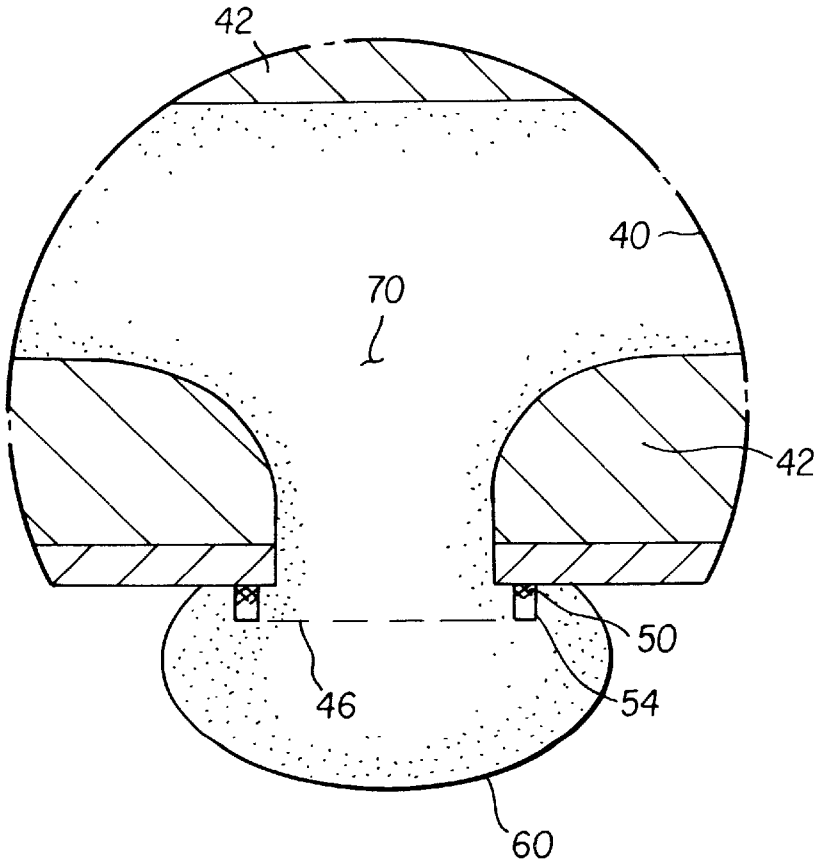
FIG. 5 (PRIOR ART)
FIG. 5 is a cross section of the prior art nozzle tip of FIG. 1 in accordance with operation as shown in FIG. 4.
Figure 6:
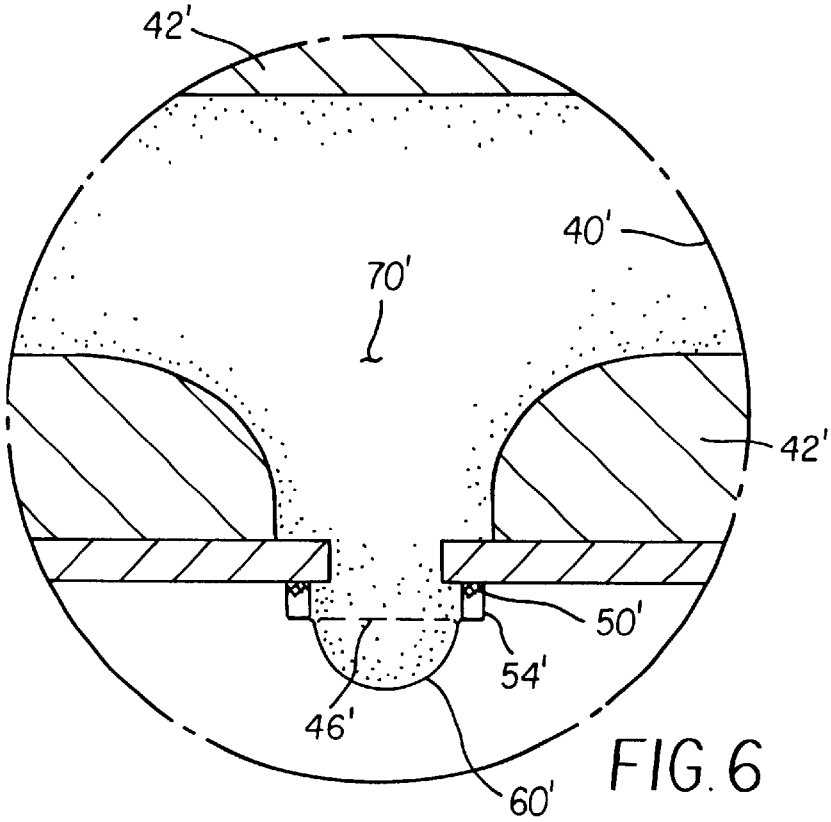
FIG. 6 is a cross section of the nozzle tip of an ink jet print head in accordance with the present invention.

FIG. 6 is a detail enlargement of a cross-sectional view of a single nozzle of the drop-on-demand ink jet print head according to a preferred embodiment of the present invention. An ink delivery channel 40', along with a plurality of cylindrical nozzle bores 46' are etched in a silicon substrate 42', which is silicon in this example. In this example, delivery channel 40' and nozzle bore 46' were formed by anisotropic wet etching of silicon, using a $p^+$ etch stop layer to form the shape of nozzle bore 46'. Ink 70' in delivery channel 40' is pressurized above atmospheric pressure, and forms a meniscus 60' which protrudes somewhat from nozzle rim 54' of heater 50.' The force of surface tension, which tends to hold the drop in, balances the force of the ink pressure, which tends to push the drop out.

According to the invention, nozzle bore 46' has a very small diameter of, say about 4 microns, and preferably between about 3 and 4 microns. Even smaller nozzle bores may be operable in accordance with the present invention. Because of the small diameter, an ink meniscus in the nozzle will have a very high Laplace pressure, that is, a very high pressure due to surface tension. It can therefore counter a very high pressure in ink delivery channel 40'. Even pressures considerably above atmospheric pressure cannot overcome the Laplace pressure to eject fluid from the nozzle. In accordance with the preferred embodiment, Laplace pressures between about 1.5 atmospheres and 1.7 atmospheres are expected for a 4 microns bore.

Figure 7:
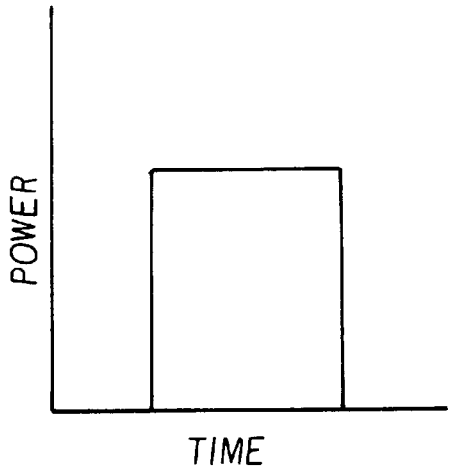
FIG. 7 is a graph showing the operation of the print head of FIG. 6.
Figure 8:
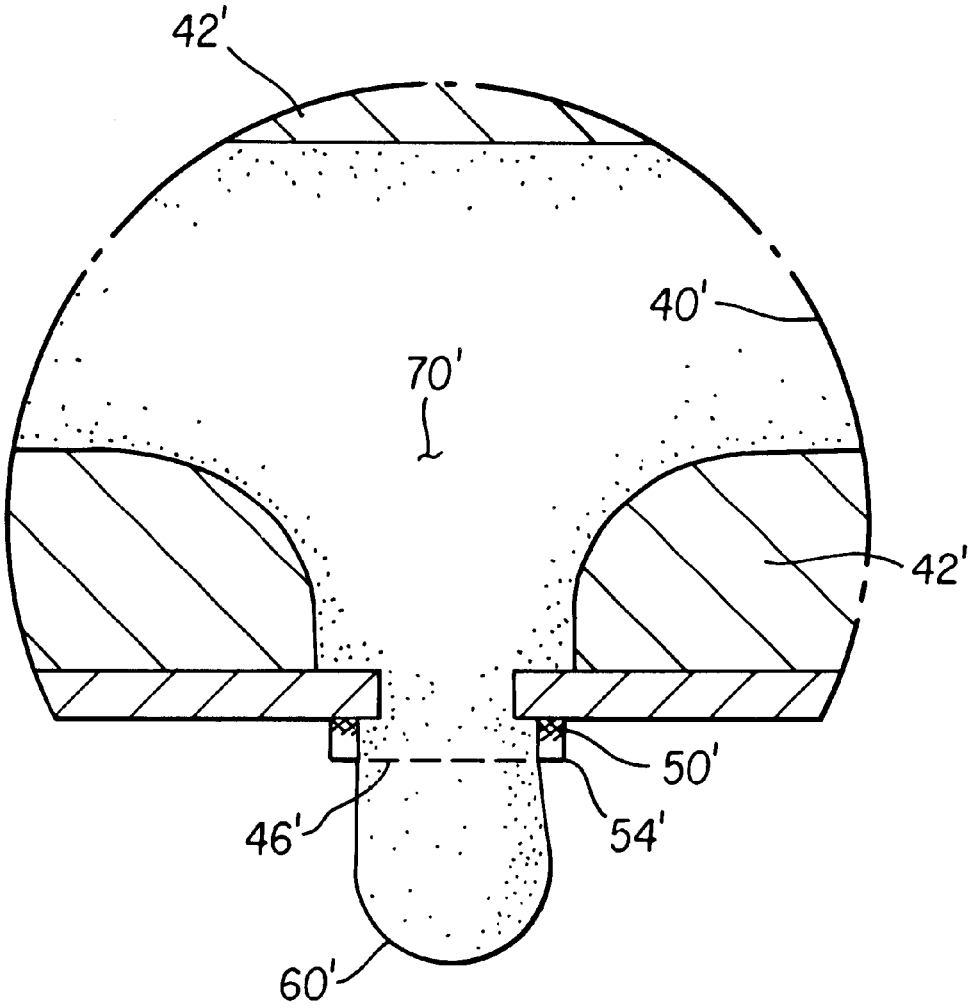
FIGS. 8–10 are cross sectional views of the nozzle tip of an ink jet print head of FIG. 6 in different stages of operation.
Figure 9:
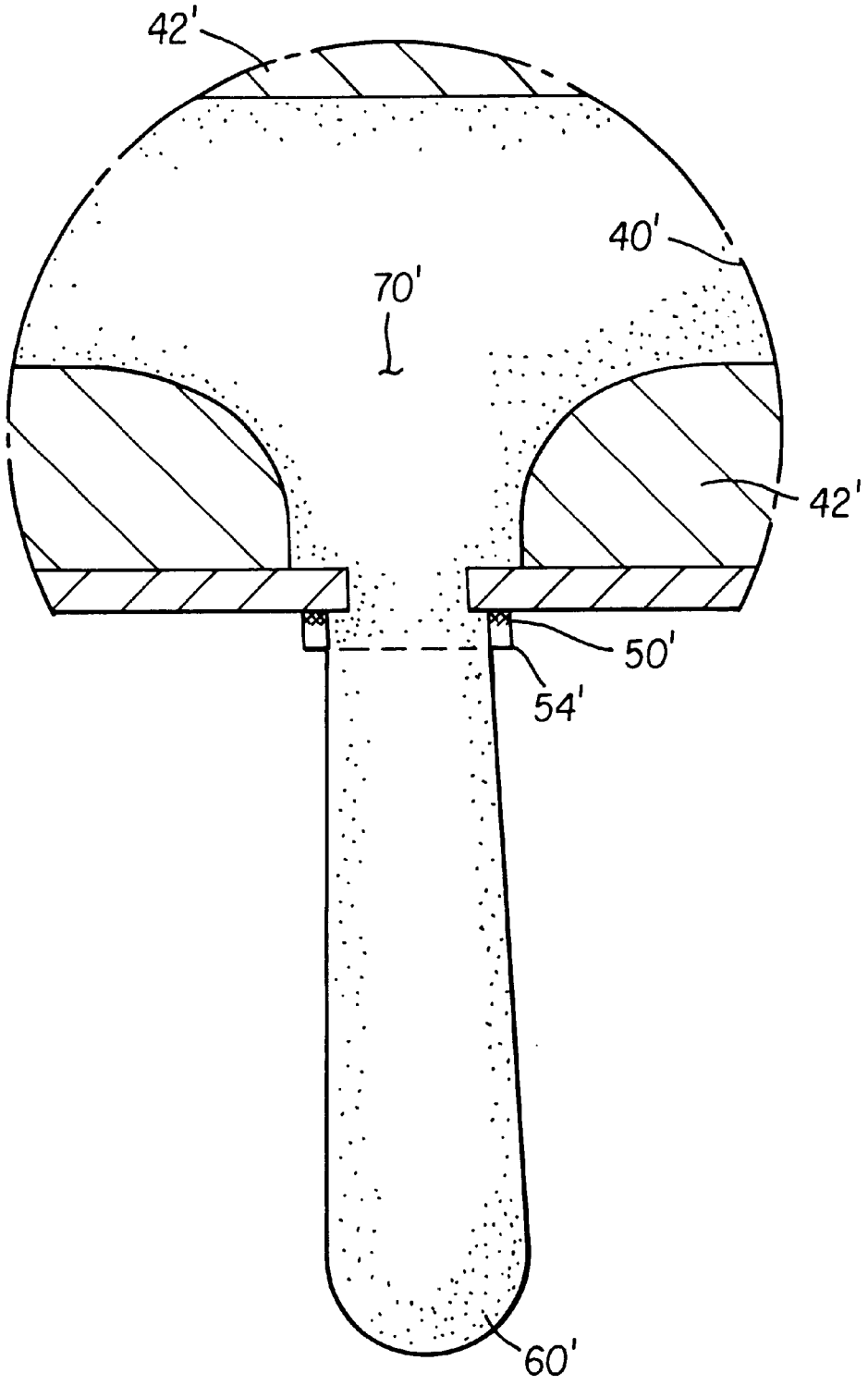
Figure 10:
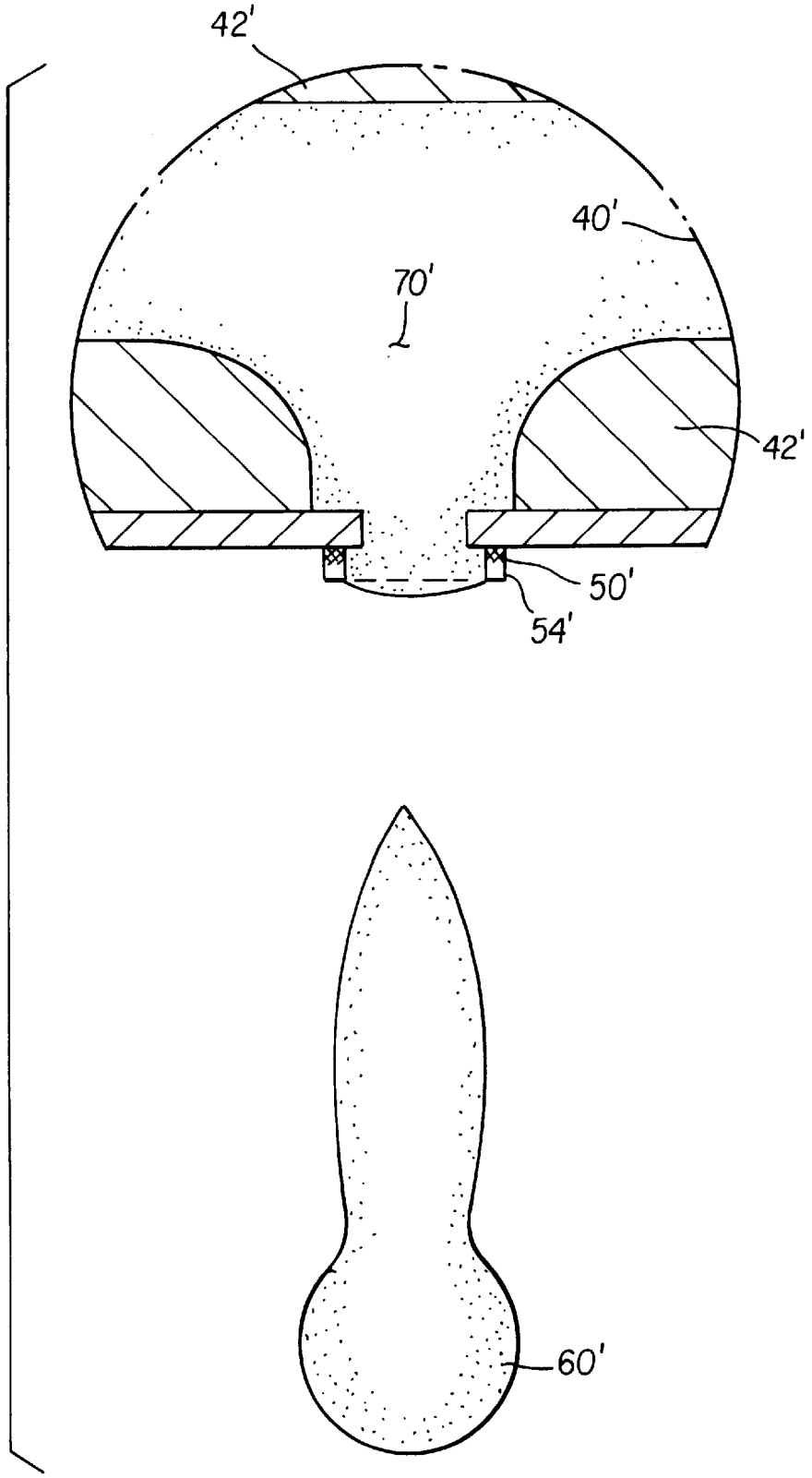

When a drop is desired, heater 50' along nozzle rim 54' is turned on. A typical voltage profile that would be used to drive current through the heater is shown in FIG. 7. Because of the heat, the surface tension of the fluid drops, and along with it, the Laplace pressure. FIG. 8 shows the emergence of meniscus60' from the nozzle just after it has been heated. Because of the very high reservoir pressure, the reduction of the Laplace pressure causes a high pressure drop that ejects a stream of fluid from the nozzle at high speed. The stream flows from the nozzle as long as the heater is left on. FIG. 9 shows a schematic of the emerging stream of fluid at a time near the middle of the ejection. When enough fluid to form a drop of the desired size has flowed from nozzle bore 46', heater 50' is turned off and the increased surface tension increases the Laplace pressure and chokes off the stream. FIG. 10 shows the fluid stream just after the heater has been turned off. The stream is forming into a drop at its head, and has necked off from the fluid in the reservoir at its tail. A new meniscus is formed. Some time after the termination of the heater pulse, the stream forms into a spherical drop, and the meniscus has assumed its equilibrium shape.

Figure 11:
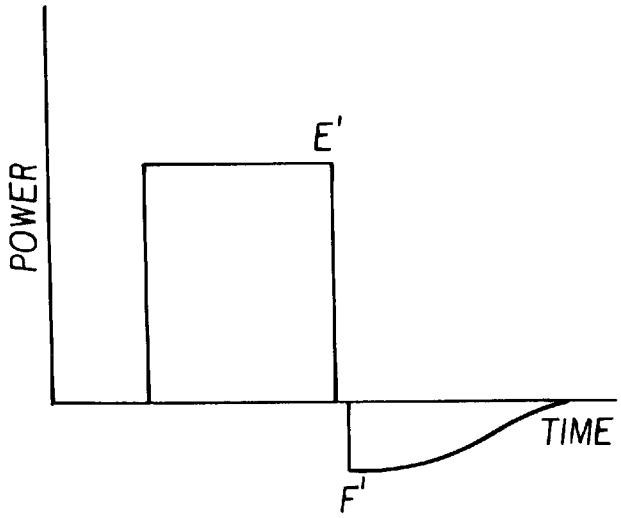
FIG. 11 is a graph showing the operation of the printhead of FIG. 6.

We have found surprisingly that for bore diameters less than about 4 microns and for pulses longer than the time required for meniscus volume doubling, a cylindrical stream of arbitrary volume is ejected, the volume being proportional to pulse length, ink velocity, and bore area. The variation in drop volume can be three fold or larger. Referring again to FIG. 6, the rear wall of the ink chamber may be moveable away from nozzle bore 46' to rapidly decrease to pressure of ink in chamber 70'. The wall is triggered at regular intervals in such a way as to send a negative pressure pulse through the ink to all of the nozzles, at time F' in FIG. 11. Time F' nearly coincides with time E', that time at which the heater pulse is terminated. In this way, the negative pressure caused by the movement of the wall aids in the termination of the streams. In this embodiment, the wall is preferably a piezoelectric element.

The invention has been described in detail with particular reference to preferred embodiments thereof, but it will be understood that variations and modifications can be effected within the spirit and scope of the invention.

What is claimed is:

1. Apparatus for controlling ink in an ink jet printer, said apparatus comprising:

an ink delivery channel;

a source of pressurized ink communicating with the ink delivery channel;

a nozzle bore which opens into the ink delivery channel to establish an ink flow path, the nozzle bore defining a nozzle bore perimeter, inherent surface tension of pressurized ink in the nozzle bore forming an ink meniscus;

a selectively-actuated heater associated with the nozzle bore to cause a reduction in the surface tension of the ink when activated such that ink flows from the nozzle bore in a continuous stream substantially for a duration of activation of the heater only.

2. Apparatus as set forth in claim 1 wherein said nozzle bore is about 4 microns in diameter.

3. Apparatus as set forth in claim 1 wherein said nozzle bore is less than 4 microns in diameter.

4. Apparatus as set forth in claim 1 wherein said nozzle bore is about 3 microns in diameter.

5. Apparatus as set forth in claim 1 wherein said nozzle bore is between 3 and 4 microns in diameter.

6. Apparatus as set forth in claim 1 further comprising a controller for activating the heater for a time period longer than a time required for the ink meniscus to double in volume.

7. Apparatus as set forth in claim 1 wherein source of pressurized ink provides ink at the nozzle bore up to about 1.7 atmospheres.

8. Apparatus as set forth in claim 1 wherein source of pressurized ink provides ink at the nozzle bore between about 1.5 and 1.7 atmospheres.

9. Apparatus as set forth in claim 1 further comprising a device adapted to rapidly decrease pressure of ink communicating with the ink delivery channel following a duration of activation of the heater only.

* * * * *